US008290400B2

(12) United States Patent
Itabashi

(10) Patent No.: US 8,290,400 B2
(45) Date of Patent: Oct. 16, 2012

(54) IMAGE FORMING APPARATUS

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/951,465

(22) Filed: Nov. 22, 2010

(65) Prior Publication Data

US 2011/0064469 A1 Mar. 17, 2011

Related U.S. Application Data

(63) Continuation of application No. 12/042,095, filed on Mar. 4, 2008, now Pat. No. 7,853,176.

(30) Foreign Application Priority Data

Mar. 9, 2007 (JP) ..... 2007-059879

(51) Int. Cl.
*G03G 21/16* (2006.01)

(52) U.S. Cl. ..... 399/125

(58) Field of Classification Search ..... 399/125
See application file for complete search history.

(56) References Cited

U.S. PATENT DOCUMENTS

| | | | | |
|---|---|---|---|---|
| 5,323,210 | A * | 6/1994 | Inomata | 399/113 |
| 5,978,626 | A | 11/1999 | Nagamine et al. | |
| 6,038,417 | A | 3/2000 | Nagamine et al. | |
| 6,219,508 | B1 | 4/2001 | Nagatomi et al. | |
| 7,162,182 | B2 | 1/2007 | Tonges et al. | |
| 7,561,825 | B2 | 7/2009 | Hirose et al. | |
| 2005/0047823 | A1 * | 3/2005 | Nakashima et al. | 399/111 |
| 2005/0191087 | A1 | 9/2005 | Nishimura | |
| 2005/0196217 | A1 | 9/2005 | Nishimura et al. | |
| 2006/0050135 | A1 * | 3/2006 | Fukuda | 347/138 |
| 2006/0088336 | A1 | 4/2006 | Hirose et al. | |
| 2009/0010697 | A1 | 1/2009 | Nishimura et al. | |

FOREIGN PATENT DOCUMENTS

| | | | |
|---|---|---|---|
| JP | 03-252663 | A | 11/1991 |
| JP | 04-333066 | A | 11/1992 |
| JP | 09-146440 | A | 6/1997 |
| JP | 11-153893 | | 6/1999 |
| JP | 2005-164727 | A | 6/2005 |
| JP | 2005-164986 | A | 6/2005 |
| JP | 2005-252998 | | 9/2005 |
| JP | 2006078542 | A | 3/2006 |
| JP | 2006-119474 | A | 5/2006 |

OTHER PUBLICATIONS

English machine translation of JP 2005-164986 A.*
JP Reasons for Rejection dated Oct. 18, 2011, corresponding Application No. 2007-059879; English Translation.
Notice of Reasons for Rejection for corresponding Japanese Patent Application No. 2007-059879 dated May 22, 2012.

* cited by examiner

*Primary Examiner* — Walter L Lindsay, Jr.
*Assistant Examiner* — Ruth Labombard
(74) *Attorney, Agent, or Firm* — Banner & Witcoff, Ltd.

(57) ABSTRACT

An image forming apparatus has a holding member having a plurality of photosensitive drums and configured to hold a plurality of toner cartridges in a detachable manner. The holding member is coupled to an apparatus body in a tiltable manner between a first position where the holding member is disposed in the apparatus body and a second position where the holding member is raised from the apparatus body. A top cover is coupled to the apparatus body in a tiltable manner between a closed position and an open position. The top cover tilts in a different direction from a direction that the holding member tilts.

26 Claims, 10 Drawing Sheets

IMAGE FORMING APPARATUS

CROSS REFERENCE TO RELATED APPLICATION

This application is a continuation of prior application Ser. No. 12/042,095, filed Mar. 4, 2008, which claims priority from Japanese Patent Application No. 2007-059879 filed on Mar. 9, 2007, the entire subject matter of which is incorporated herein by reference.

FIELD

Aspects of the invention relate to image forming apparatuses such as electrophotographic printers and copiers.

BACKGROUND

Known image forming apparatuses, e.g. electrophotographic printers or copiers, generally use a light-emitting diode (LED) head array for exposing a photoconductive drum to light.

LED head arrays are mounted on an inner side of a lid or top cover pivotally mounted to the top of a body of an image forming apparatus. When the lid is positioned at an open position, the LED head arrays are separated and withdrawn from corresponding photosensitive drums of process cartridges disposed in the body of the apparatus.

In the image forming apparatus, a toner cartridge is installed in each process cartridge. When the toner cartridge is replaced with a new one, the top cover should be opened widely so as to prevent the toner cartridge and the LED head array from interfering with each other.

However, to open the top cover widely, great space is required above the image forming apparatus. If such a space is not secured, replacement of the toner cartridge becomes difficult.

SUMMARY

Aspects of the invention provide an image forming apparatus configured to facilitate toner cartridge replacement even if a large space is not provided above the image forming apparatus.

BRIEF DESCRIPTION OF THE DRAWINGS

Illustrative aspects of the invention will be described in detail with reference to the following figures in which like elements are labeled with like numbers and in which.

DETAILED DESCRIPTION

An illustrative aspect of the invention will be described in detail with reference to the accompanying drawings. An image forming apparatus according to aspects of the invention applies to a multifunction printer (MFP) having a copier function, printer function, scanner function and facsimile function. It will be appreciated that aspects of the invention apply to other types of image forming apparatuses as well.

Figure 1:
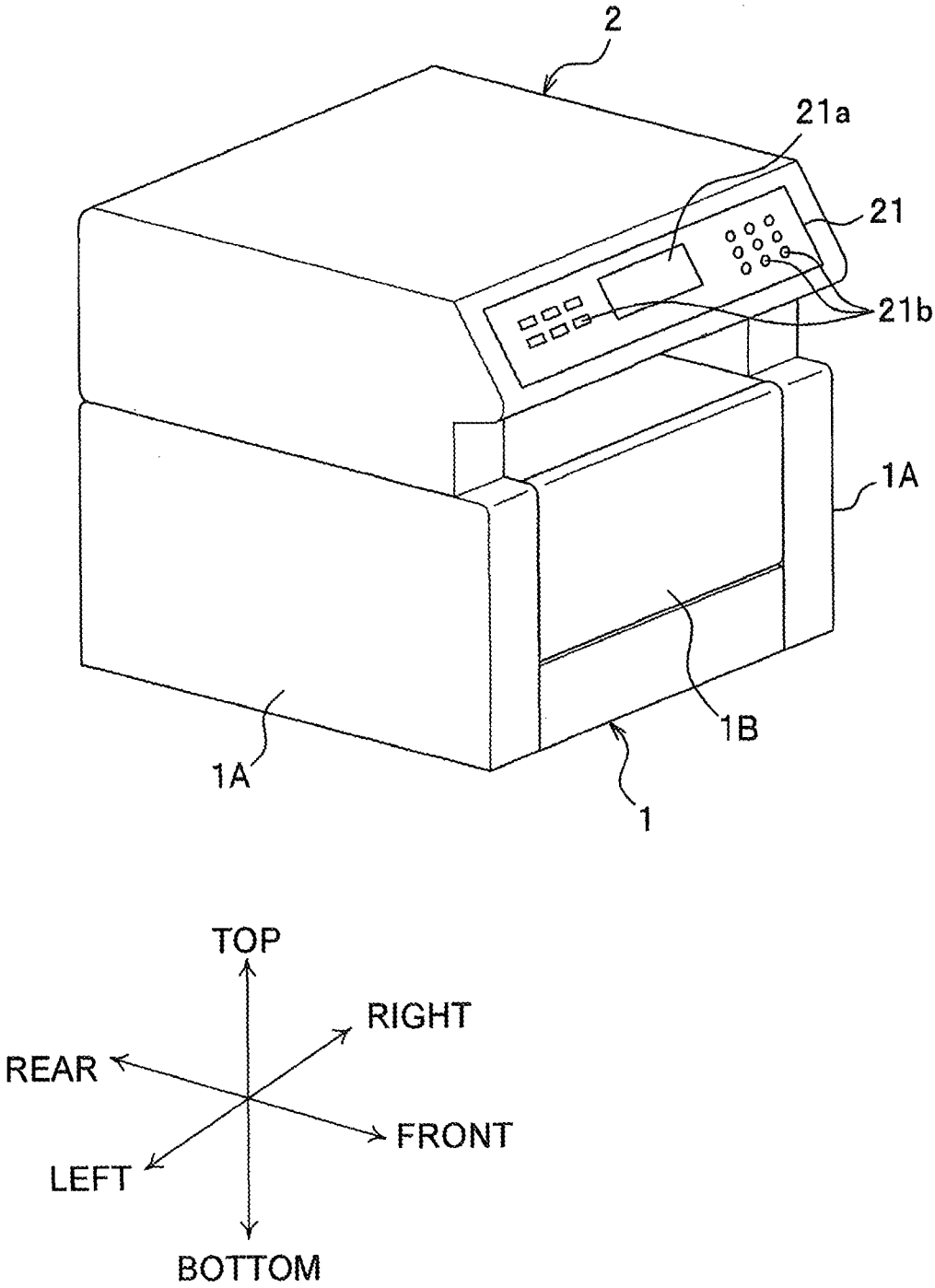
FIG. 1 is a perspective view of an image forming apparatus according to an illustrative aspect of the invention.

As shown in FIG. 1, an apparatus body 1 of the image forming apparatus includes side covers 1A, a front cover 1B, and a large-sized top cover 2. The top cover 2 becomes heavy when it contains a scanner and an automatic document feeder, which are not shown.

For ease of discussion, in the following description, the top or upper side, the bottom or lower side, the left or left side, the right or right side, the front or front side, and the rear or rear side of the image forming apparatus are identified by the arrows in FIG. 1. The sides of the image forming apparatus are indicated as viewed from a user in front of the image forming apparatus. With regard to various individual objects of the image forming apparatus, sides of the individual objects are similarly identified based on the arranged/attached position of the object on/in the image forming apparatus in FIG. 1.

Figure 2A:
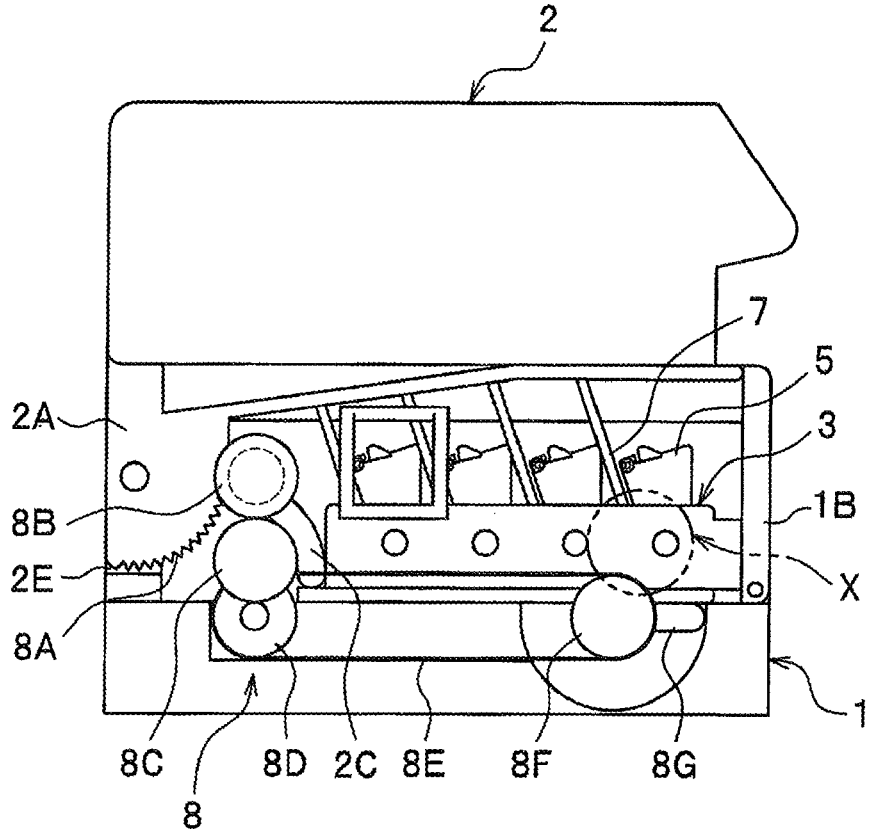
FIG. 2A is an side sectional view of an internal structure of the image forming apparatus of FIG. 1 in which a side cover is eliminated.
Figure 2B:
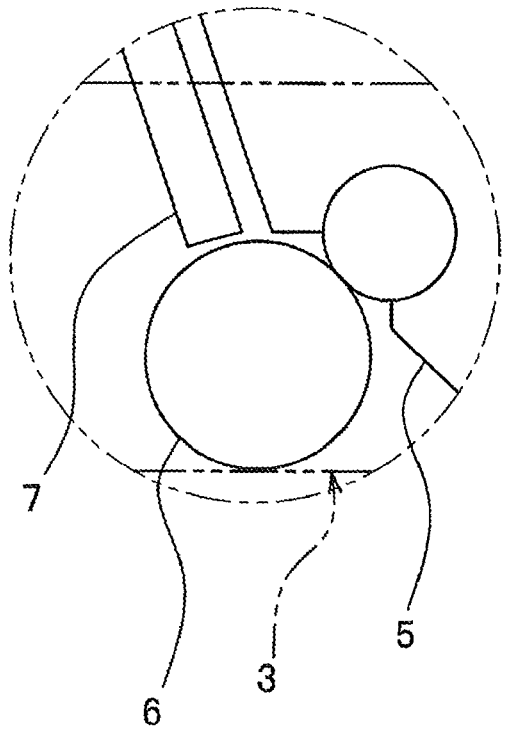
FIG. 2B is an enlarged sectional view showing an X portion of FIG. 2A.
Figure 3:
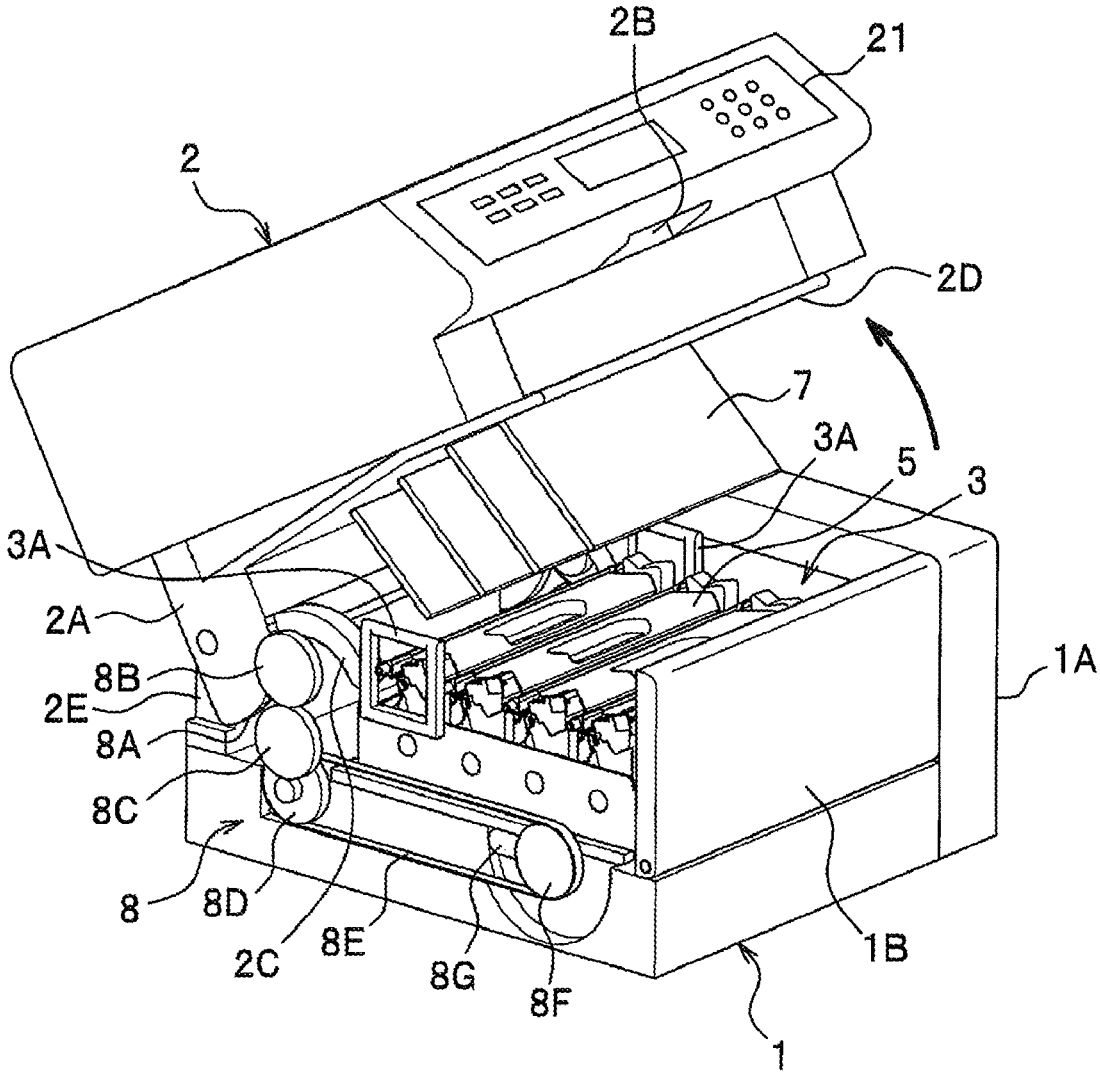
FIG. 3 is a perspective view of the image forming apparatus where a pushing lever of an interlocking mechanism shown in FIG. 2 is in contact with a lower surface of a cartridge holding member.

As shown in FIG. 2A, a cartridge holding member 3 is accommodated in the apparatus body 1. A front surface of the apparatus body 1 contains front cover 1B fixed in an upright position at a front end of the cartridge holding member 3. The front cover 1B is pivotally mounted at its lower end to the apparatus body 1 so that the cartridge holding member 3 is tiltable from a storage position (FIG. 2B) where the cartridge holding member 3 is accommodated in the apparatus body 1 generally horizontally, upward and frontward to a replacement position (FIGS. 7 and 8) where the cartridge holding member 3 stands substantially vertically. In other words, the cartridge holding member 3 is coupled to the apparatus body 1 via the front cover 1B in a tiltable manner from the storage position, upward and frontward, to the replacement position. When the cartridge holding member 3 is in the storage position, light emitting diode (LED) head arrays 7 can be positioned with respect to corresponding photosensitive members 6. When the cartridge holding member 3 is in the replacement position, each toner cartridge 5 can be replaced. As shown in FIG. 3, a pair of holding portions 3A for tilting the cartridge holding member 3 manually is attached to rear ends of side surfaces of the cartridge holding member 3.

The top cover 2 includes a pair of link arms 2A (only one shown) protruding downward at a rear end. The link arms 2A are pivotally mounted to an upper end of a rear wall 2E of the apparatus body 1, so that the top cover 2 is tiltable upward oppositely to the cartridge holding member 3. More specifically, the top cover 2 is tiltable upward and rearward, from a closed position (FIG. 2) where the top cover 2 covers the cartridge holding member 3 accommodated substantially horizontally in the apparatus body 1, via a tilted position shown in FIGS. 3 and 4 where the cartridge holding member 3 accommodated in the apparatus body 1 becomes exposed gradually, to an open position shown in FIGS. 5 and 6. In other words, the top cover 2 is coupled to the apparatus body 1 in a tiltable manner upward and rearward, from the closed position, via the tilted position, to the open position. When the top cover 2 is in the closed position, each LED head array 7 is positioned with respect to its corresponding photosensitive drum 6. When the top cover 2 is in the open position, each LED head array 7 is withdrawn from its corresponding photosensitive drum 6.

When the top cover 2 is heavy as it contains the scanner and the automatic document feeder, an inclination angle of the top cover 2 in the open position is set in a range that the center of gravity of the top cover 2 is projected within the apparatus body 1 when the image forming apparatus is viewed from above. The apparatus body 1 is provided with a lock mechanism (not shown) configured to maintain the top cover 2 in the open position. As shown in FIG. 3, a finger recess 2B is formed at a front end of the top cover 2. An operation unit 21 is disposed on the front surface of the top cover 2. The operation unit 21 includes a known screen 21*a* and buttons 21*b* positioned for manipulation by a user.

Figure 4:
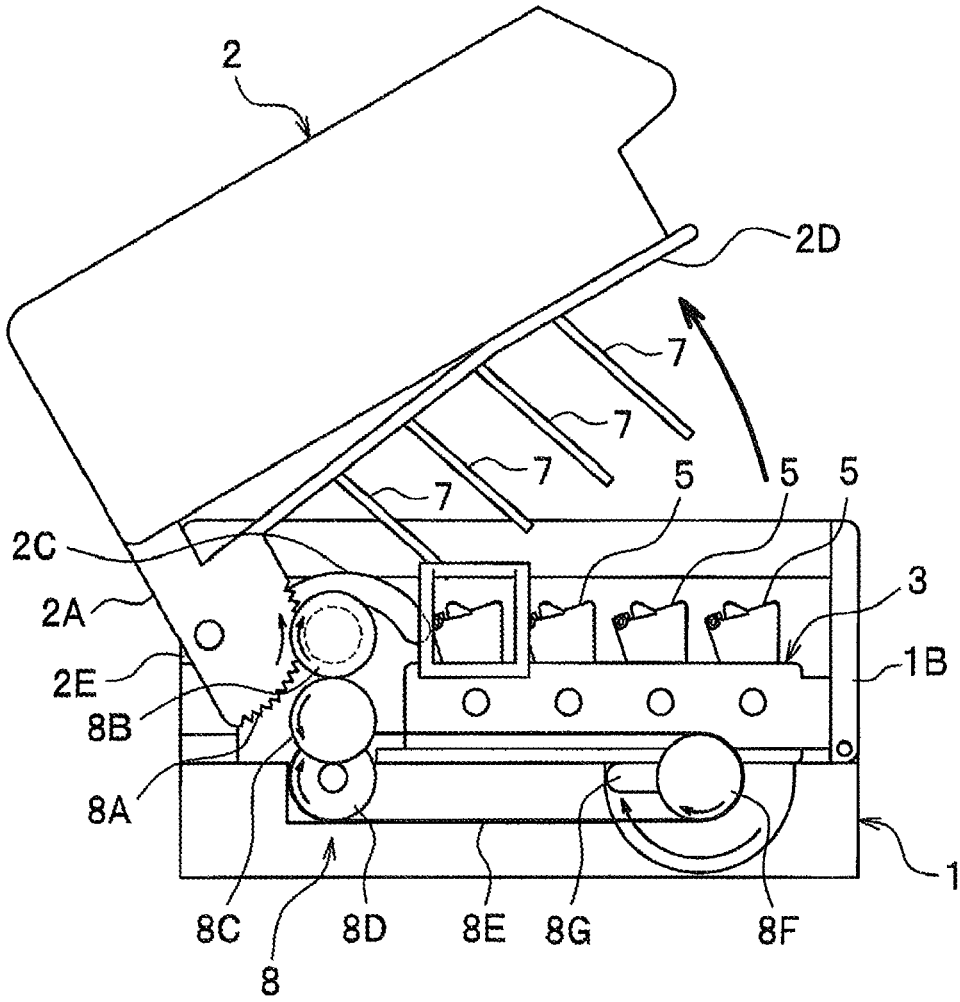
FIG. 4 is a side sectional view of the image forming apparatus of FIG. 3.
Figure 5:
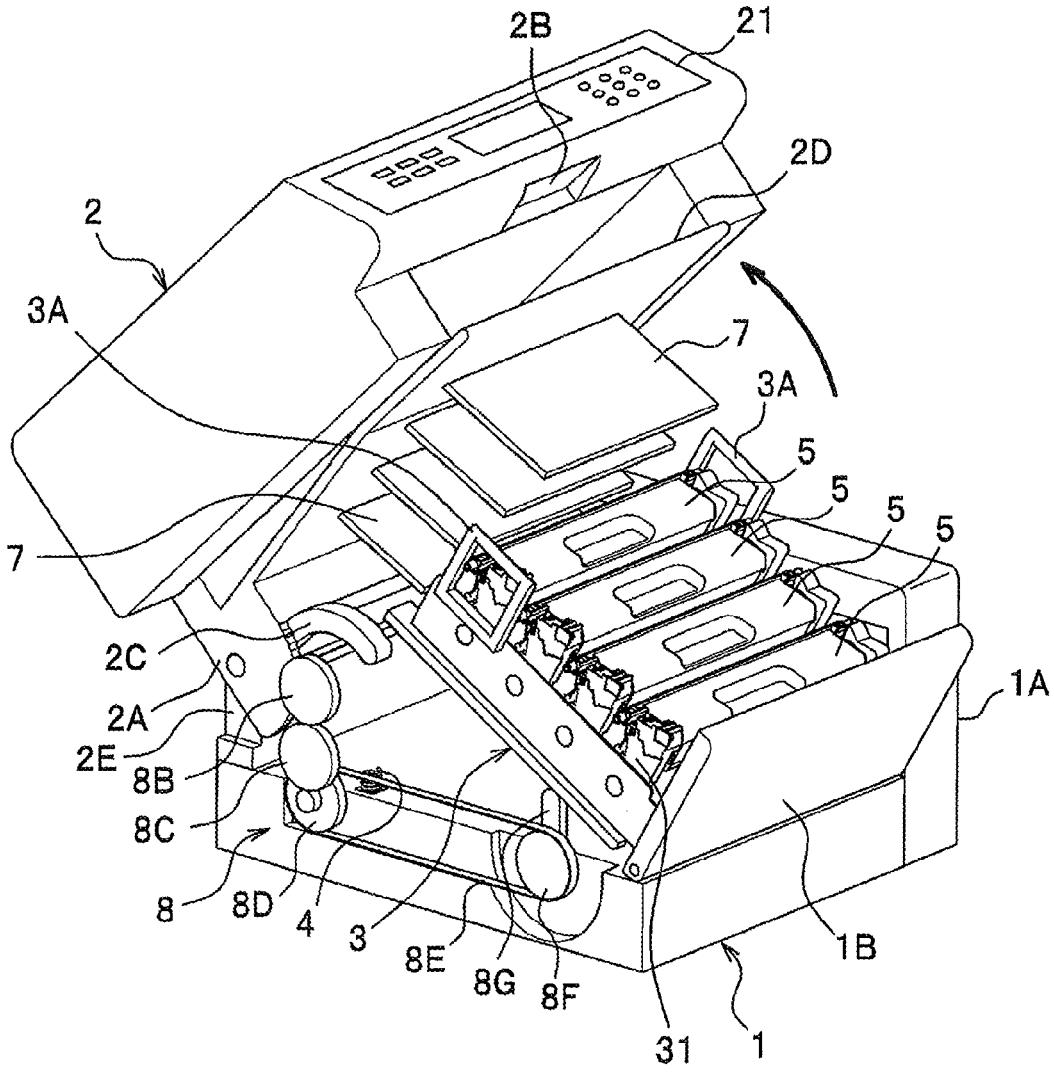
FIG. 5 is a perspective view of the image forming apparatus where a top cover shown in FIG. 2 is in an open position.
Figure 6:
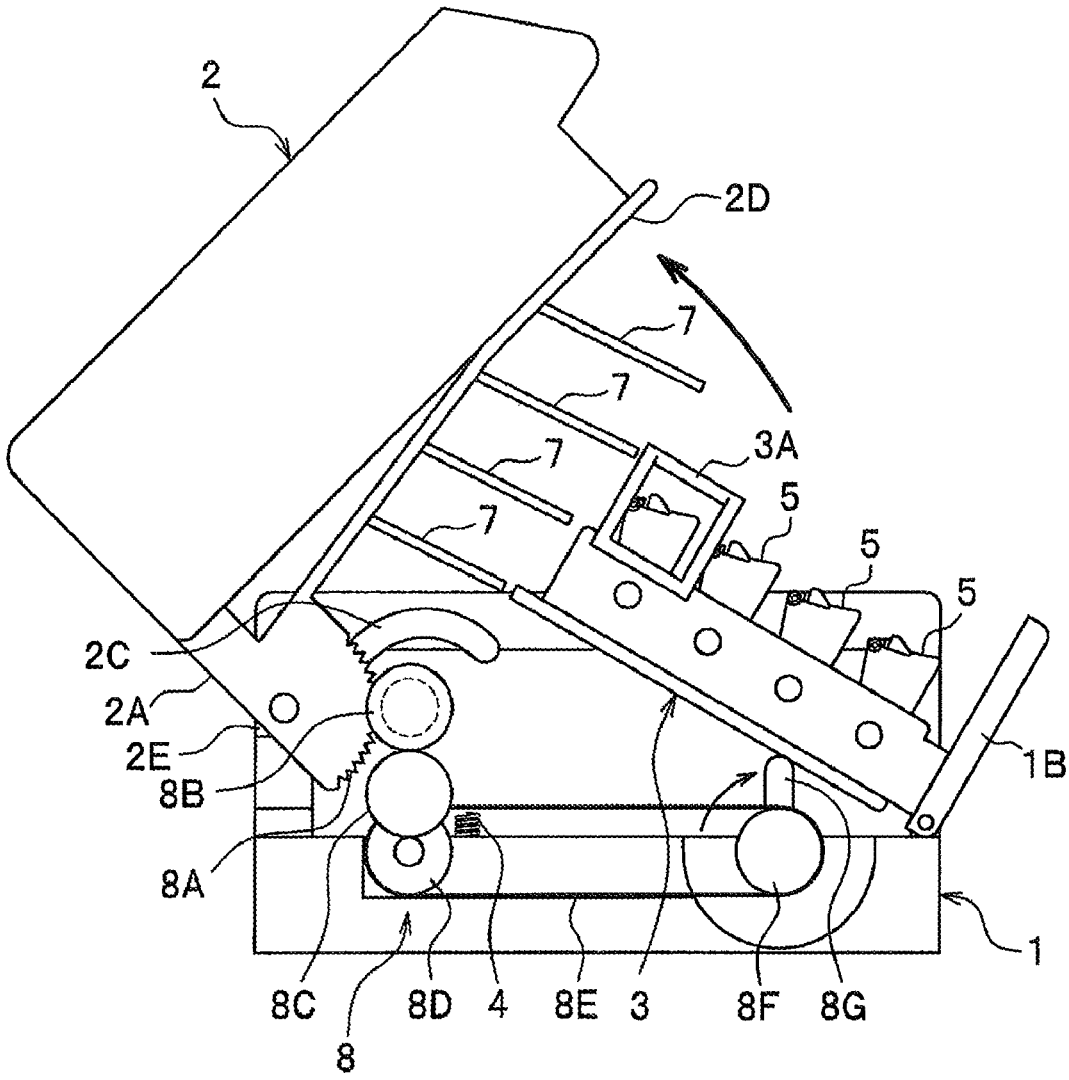
FIG. 6 is a side sectional view of the image forming apparatus of FIG. 5.

As shown in FIG. 5, a pair of coil springs 4 (only one shown) is disposed in the rear of the apparatus body 1. The coil springs 4 are configured to resiliently receive the lower surface of the cartridge holding member 3 and temporarily stop the cartridge holding member 3 at a temporary stop position just before the storage position. The link arms 2A (only one shown) of the top cover 2 are integrally formed with a pair of pushing arms 2C (only one shown). The pushing arms 2C are configured to push the cartridge holding member 3 to the storage position against elastic force of the coil springs 4, such that the cartridge holding member 3 is disposed substantially horizontally in the apparatus body 1 when the top cover 2 is in the closed position. The pushing arms 2C are curved downward toward the front and protrude so as to push the rear end of the cartridge holding member 3 as shown in FIGS. 2 and 4.

Figure 9:
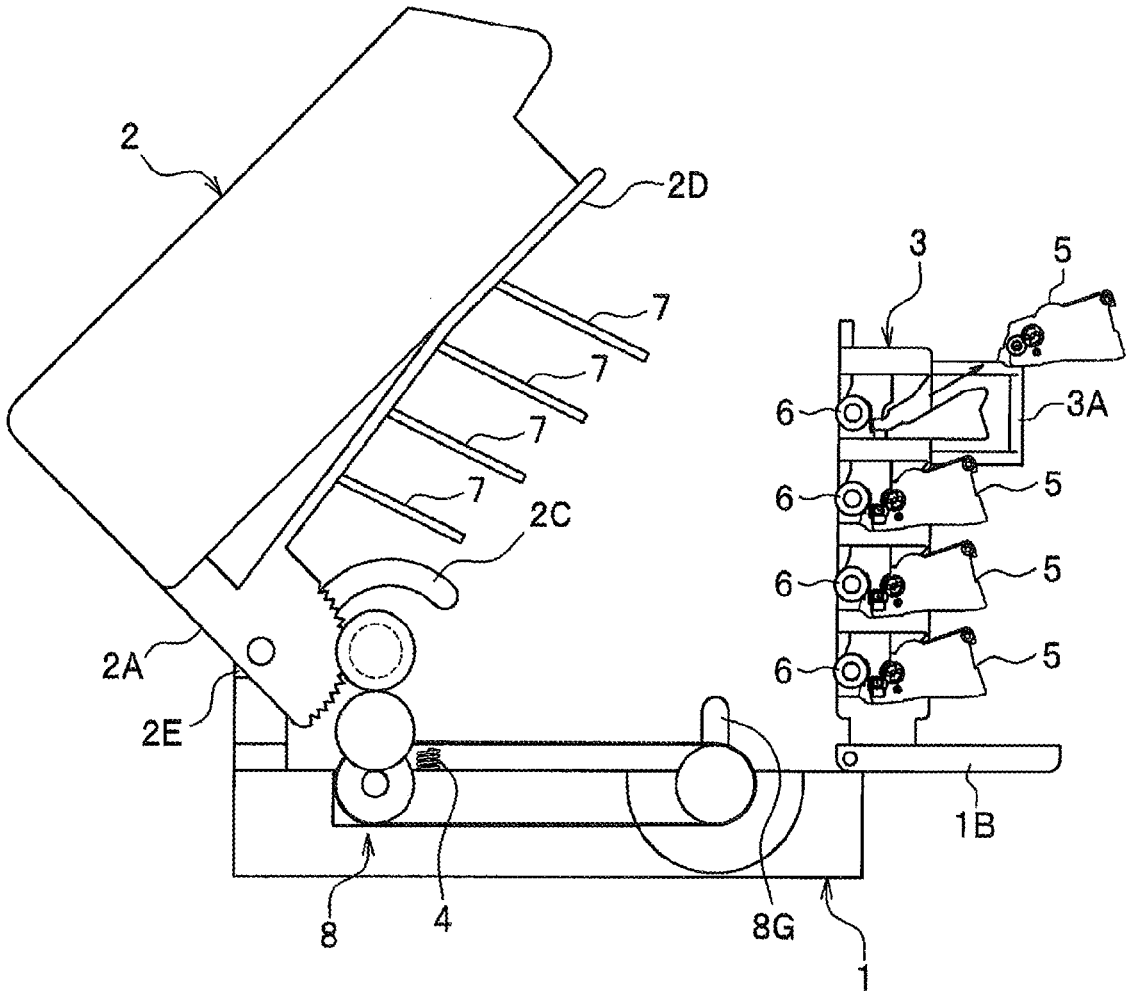
FIG. 9 is a side sectional view of the image forming apparatus of FIG. 8 showing toner cartridges and photosensitive drums installed in the cartridge holding member.
Figure 10:
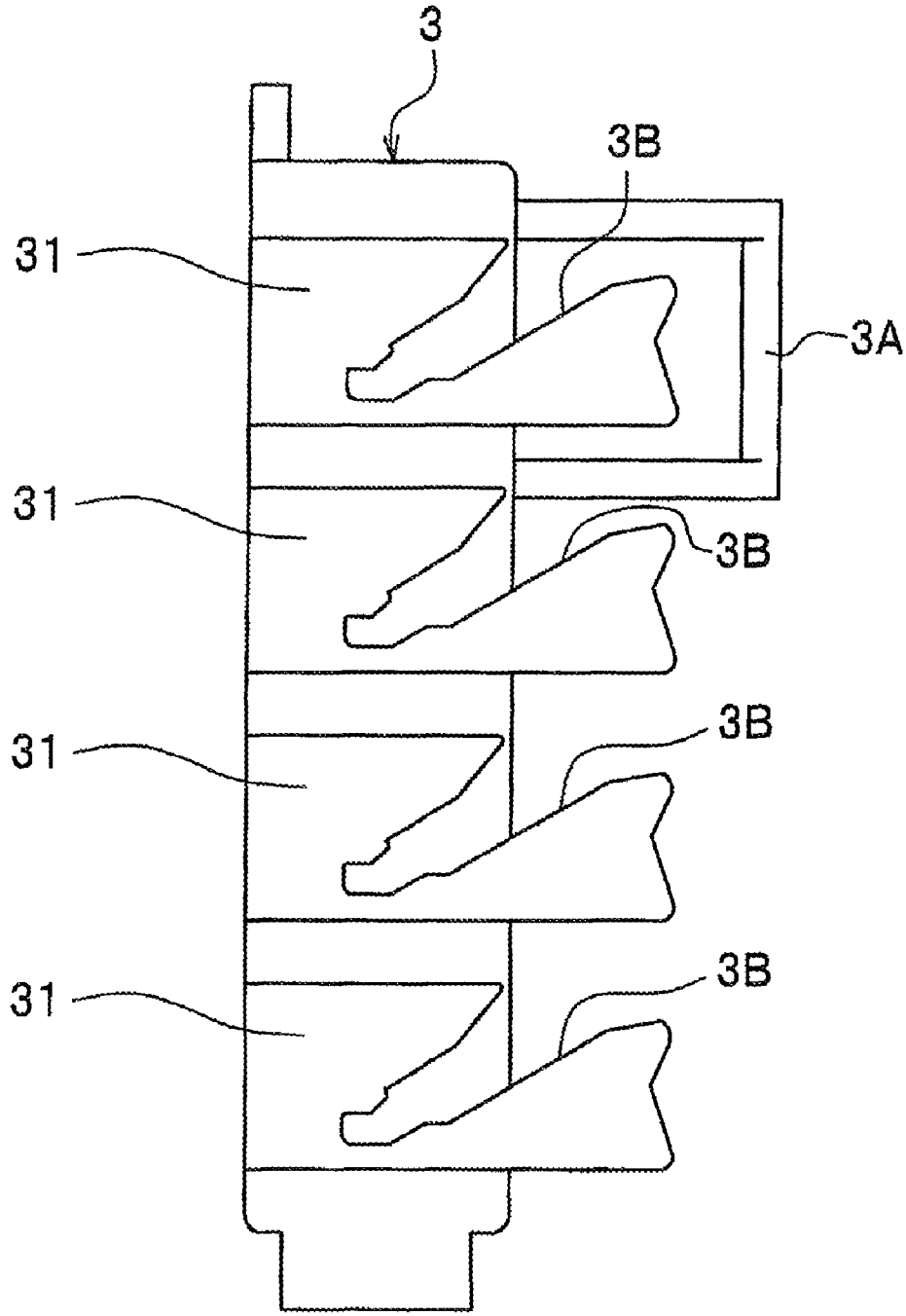
FIG. 10 is an enlarged side sectional view of the cartridge holding member of FIG. 9 showing guide grooves.

A plurality of, e.g., four, toner cartridges 5 are detachably held in the cartridge holding member 3. The toner cartridges 5 are arranged in tandem in the cartridge holding member 3. The cartridge holding member 3 includes retainer walls 31 for retaining the toner cartridges 5 detachably. As shown in FIG. 10, the retainer walls 31 have guide grooves 3B each defining a moving path of a corresponding toner cartridge 5 when attached to and removed from the cartridge holding member 3. The guide grooves 3B are formed with an angle so as to prevent the toner cartridges 5 from dropping off when the cartridge holding member 3 is tilted to the replacement position where it stands substantially vertically. In other words, each guide groove 3B is formed so that an opening is oriented diagonally upward to the front when the cartridge holding member 3 is in the replacement position. A plurality of, e.g., four, photosensitive drums 6 are mounted in association with the toner cartridges 5 in the cartridge holding member 3, as shown in FIG. 9.

As shown in FIGS. 3-6, a supporting plate 2D extends from the link arms 2A (only one shown) to the front on the lower surface of the top cover 2. The supporting plate 2D supports a plurality of, e.g., four, LED head arrays 7 arranged in tandem in association with the photosensitive drums 6. Each LED head array 7 is made up of an array of a plurality of light emitting diodes. The LED head arrays 7 are configured to expose the corresponding photosensitive drums 6 (FIG. 9) mounted in the cartridge holding member 3 to light.

As shown in FIG. 2A, the apparatus body 1 is provided with a pair of interlocking mechanisms 8 (only one shown) configured to move the cartridge holding member 3 upward in response to the upward movement of the top cover 2. Each interlocking mechanism 8 has a suspension mechanism configured to halt an interlock between the cartridge holding member 3 and the top cover 2 until the top cover 2 is tilted to the position shown in FIGS. 3 and 4 and the cartridge holding member 3 is tiltable to the front of the apparatus body 1.

Each interlocking mechanism 8 includes a circular arc gear 8A, a driven gear 8B, a reverse gear 8C, a reduction gear 8D, a chain 8E, a driven gear 8F, and a pushing lever 8G. The circular arc gear 8A is formed on the link arm 2*a* of the top cover 2. The circular arc gear 8A engages with the driven gear 8B. The driven gear 8B engages with the reverse gear 8C. The reverse gear 8C engages with the reduction gear 8D. The reduction gear 8D rotates the driven gear 8F via the chain 8E. The pushing lever 8G is fixed to the driven gear 8F and protrudes outwardly and radially from the driven gear 8F.

The driven gear 8F of the interlocking mechanism 8 is disposed below the front side of the cartridge holding member 3. When the top cover 2 is tilted upward toward the rear of the apparatus body 1, the driven gear 8F rotates clockwise as shown in FIG. 4 while reducing speed. When the pushing lever 8G rotates a half turn clockwise along with the driven gear 8F from an initial position shown in FIG. 2A in which the pushing lever 8G protrudes rightward of the driven gear 8F, it contacts the lower surface of the cartridge holding member 3 as shown in FIGS. 3 and 4. When the pushing lever 8G further rotates clockwise direction from the contact position, it raises the cartridge holding member 3 to the front of the apparatus body 1.

The suspension mechanism includes a mechanism from the reduction gear 8D to the pushing lever 8G to suspend the upward movement of the cartridge holding member 3 until the top cover 2 is tilted to the position shown in FIGS. 3 and 4 and the cartridge holding member 3 is tiltable.

When a toner cartridge 5 held in the cartridge holding member 3 in a detachable manner is replaced with a new one, the top cover 2 is raised from the closed position shown in FIG. 2 toward the rear of the apparatus body 1 by placing the user's fingers at the finger recess 2B shown in FIG. 3.

When the top cover 2 is tilted to the position shown in FIGS. 3 and 4, the cartridge holding member 3 becomes ready to be tilted toward the front of the apparatus body 1 in response to the movement of the top cover 2. In other words, the pushing lever 8G of the interlocking mechanism 8 contacts the lower surface of the cartridge holding member 3. When the top cover 2 is tilted further to the open position shown in FIGS. 5 and 6, the pushing lever 8G of the interlocking mechanism 8 pushes the lower surface of the cartridge holding member 3*d* upward, and the cartridge holding member 3 is raised toward the front of the apparatus body 1.

Figure 7:
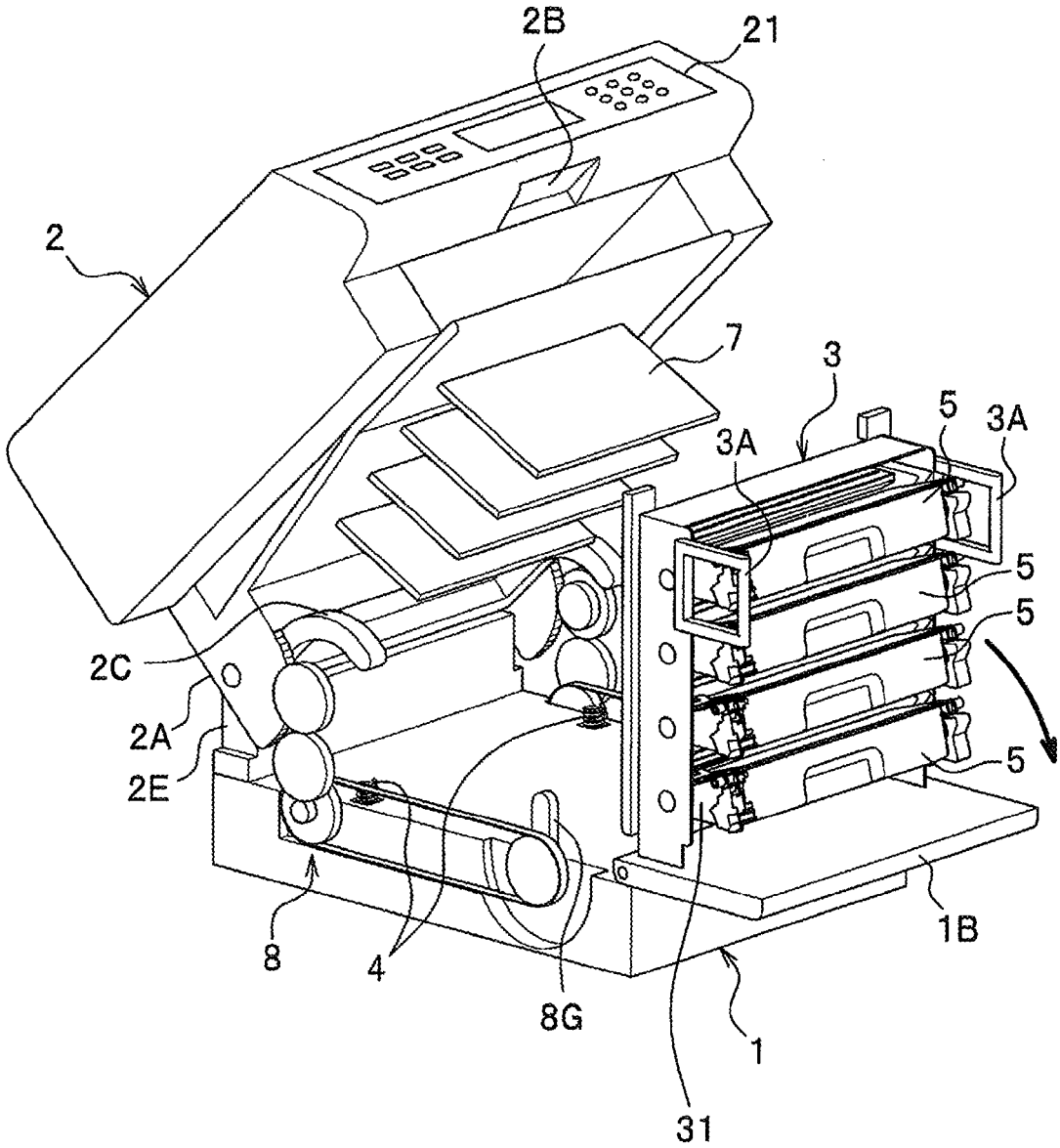
FIG. 7 is a perspective view of the image forming apparatus where the cartridge holding member of FIG. 2 is in a replacement position.
Figure 8:
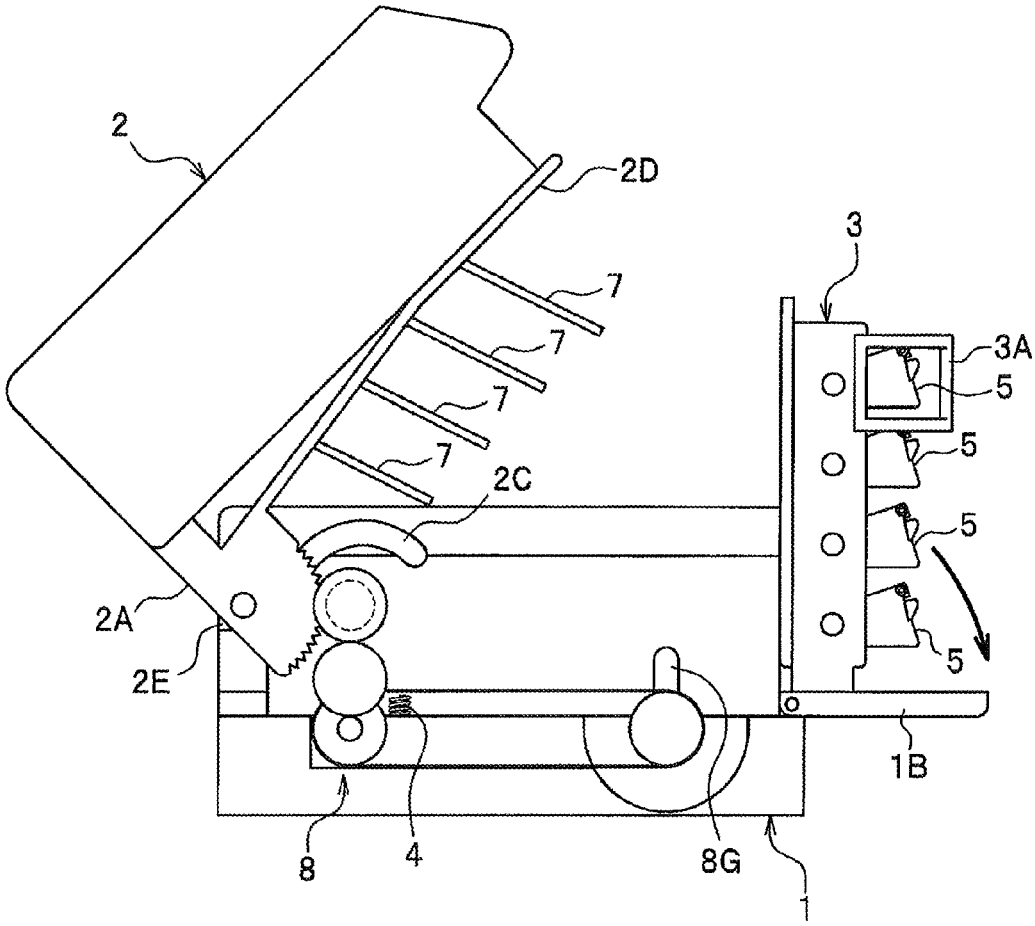
FIG. 8 is a side sectional view of the image forming apparatus of FIG. 7.

The user grasps the holding portions 3A of the cartridge holding member 3 and tilts the cartridge holding member 3 to the replacement position shown in FIGS. 7 and 8. The cartridge holding member 3 is then maintained at the upright position by a stopper (not shown) provided in the apparatus body 1. As the openings of the guide grooves 3B of the cartridge holding member 3 face diagonally toward the front, the toner cartridges 5 are prevented from dropping off. A toner cartridge 5 can be replaced as shown in FIG. 9.

After replacement of the toner cartridge 5, the user tilts the cartridge holding member 3 toward the rear of the apparatus body 1. When the cartridge holding member 3 reaches the tilted position shown in FIGS. 5 and 6, the pushing lever 8G of the interlocking mechanism 8 contacts the lower surface of the cartridge holding member 3. The top cover 2 is pushed downward toward the front of the apparatus body 1. The pushing lever 8G of the interlocking mechanism 8 rotates from the position shown in FIGS. 5 and 6 to the position shown in FIGS. 3 and 4, and the cartridge holding member 3 is tilted downward in response to the movement of the pushing lever 8G.

At this time, the cartridge holding member 3 is temporarily stopped at the position just before the storage position as the lower surface of the cartridge holding member 3 is resiliently received at the rear by the coil springs 4 (only one shown in FIGS. 5 and 6) installed in the apparatus body 1. Thus, the coil springs 4 absorb the shock of the cartridge holding member 3 being tilted downward, so that the cartridge holding member 3 is temporarily stopped just before the storage position. The toner cartridges 5 and the photosensitive drums 6 held in the cartridge holding member 3 are prevented from getting damaged.

When the top cover 2 is pushed further downward, the pushing arms 2C of the top cover 2 push the cartridge holding member 3 at the rear against the elastic force of the coil springs 4, from the temporarily stop position to the storage position. When the top cover 2 is returned to the closed position, it is locked by a locking mechanism (not shown), the cartridge holding member 3 is maintained at the storage position, and each LED head array 7 is positioned with respect to its corresponding photosensitive drum 6.

Advantages of aspects of the image forming apparatus described above include the following.

The cartridge holding member 3 is coupled to the apparatus body 1 so that the cartridge holding member 3 is tiltable upward in the direction opposite to the top cover 2. Even if the top cover 2 is not widely opened, the cartridge holding member 3 can be tilted from the storage position to the replacement position to provide a space where the toner cartridge 5 can be replaced. Thus, even if there is not a large space above the image forming apparatus, the toner cartridges 5 can be easily replaced. If the top cover 2 is heavy because it contains a scanner, the toner cartridges 5 can be easily replaced.

The operation unit 21 is disposed at the front end of the top cover 2. The user stands in front of the operation unit 21 to operate the image forming apparatus. When the user tilts the top cover 2 toward the rear, the cartridge holding member 3 is raised toward the user. Thus, the toner cartridge 5 can be easily replaced.

The tilted angle of the top cover 2 in the open position is set in the range where the center of gravity of the top cover 2 is projected within the apparatus body 1 when viewed from above. Thus, the balance of the top cover 2 can be maintained and prevent the apparatus body 1 from toppling.

The interlocking mechanisms 8 allow the cartridge holding member 3 to tilt upward to the front of the apparatus body 1 in response to the upward movement of the top cover 2 toward the rear of the apparatus body 1. The suspension mechanisms of the interlocking mechanisms 8 halt the upward movement of the cartridge holding member 3 until a moving path of the cartridge holding member 3 is secured. Thus, this halt can prevent the LED head arrays 7 of the top cover 2 and the toner cartridges 5 of the cartridge holding member 3 from interfering with each other or causing damage.

The LED head arrays 7 of the top cover 2 and the toner cartridges 5 of the cartridge holding member 3 do not interfere with each other. Thus, the spaces between the toner cartridges 5 installed in the cartridge holding member 3 can be reduced. In this case, the front-rear dimension of the cartridge holding member 3 can be reduced, and the front-rear dimension of the apparatus body 1 can be also reduced.

When the cartridge holding member 3 is returned from the replacement position to the storage position, the cartridge holding member 3 is resiliently received by the coil springs 4 and temporarily stopped at the temporary stop position just before the storage position. This prevents damage to the toner cartridges 5 and the photosensitive drums 6 held in the cartridge holding member 3.

By pressing the top cover 2 downward, the cartridge holding member 3 is pressed down from the temporary stop position to the storage position in the apparatus body 1. Simultaneously, the top cover 2 also returns to the closed position. Thus, the photosensitive drums 6 of the cartridge holding member 3 and the LED head arrays 7 of the top cover 2 can be easily positioned with respect to each other.

The front cover 1B on the front surface of the apparatus body 1 is tiltable together with the cartridge holding member 3 because the front cover 1B is fixed to the front end of the cartridge holding member 3. The toner cartridge 5 positioned the most frontward when the cartridge holding member 3 is positioned in the storage position can be easily replaced when the cartridge holding member 3 is in the replacement position.

The holding portions 3A are disposed at the rear side of the cartridge holding member 3, so that the user can easily raise the cartridge holding member 3 frontward.

The invention is not limited to the above aspects and can be applied to various aspects as described below.

The coil springs 4 provide a temporarily stopping device to resiliently receive the cartridge holding member 3. Instead of the coil springs 4, rubbers and leaf springs may be used. The temporarily stopping device need not be disposed in the apparatus body 1, and may be disposed on the lower surface of the cartridge holding member 3.

In the above embodiment, the LED head arrays 7 are used as an illustrative light source. Any suitable light source may be used such as an array of organic electroluminescence light-emitting elements or fluorescent light emitting elements. To control light amount from the light source, the light emitting elements may emit light selectively according to image data. Alternatively, a plurality of liquid crystal or lead-lanthanum-zirconate-titanate (PLZT) optical shutters may be arranged to selectively control the time to open/close each optical shutter.

While the features herein have been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an apparatus body;

a holding member configured to hold one or more photosensitive drums and one or more cartridges, the holding member being coupled to the apparatus body and configured to be moved between a first position where the holding member is disposed in the apparatus body and a second position where the holding member is raised from the first position;

a top cover coupled to the apparatus body and configured to be moved between a closed position and an open position; and an interlocking mechanism including a plurality of gears arranged in the apparatus body, wherein movement of the top cover from the closed position to the open position causes rotation of at least one of the plurality of gears of the interlocking mechanism, such that the rotation of the at least one of the plurality of gears moves the holding member from the first position to the second position.

2. The image forming apparatus according to claim 1, wherein the top cover is configured to pivot in a first direction different from a second direction in which the holding member pivots.

3. The image forming apparatus according to claim 1, wherein the interlocking mechanism further includes a suspension mechanism configured to maintain an interlocking state between the holding member and the top cover until the top cover is moved to a position between the closed position and the open position.

4. The image forming apparatus according to claim 3, wherein the top cover includes a document reading apparatus.

5. The image forming apparatus according to claim 4, wherein the top cover includes an operation unit for manipulation by a user, and the operation unit is positioned at an end of the top cover opposite to an end where the top cover is coupled to the apparatus body.

6. The image forming apparatus according to claim 1, further comprising a temporary stopping device configured to resiliently receive the holding member and temporarily stop the holding member at a temporary stop position just before the first position when the holding member is moved from the second position to the first position.

7. The image forming apparatus according to claim 6, wherein the temporary stopping device comprises a coil spring.

8. The image forming apparatus according to claim 6, wherein the top cover is configured to receive a downward force and to apply the force to the holding member to move the holding member from the temporary stop position to the first position.

9. The image forming apparatus according to claim 1, wherein the holding member includes a holding portion for moving the holding member.

10. The image forming apparatus according to claim 1, wherein the apparatus body comprises a front cover configured to move with the holding member.

11. The image forming apparatus according to claim 1, wherein the holding member includes a plurality of guide grooves, wherein each guide groove defines a moving path of a corresponding one of the cartridges when the cartridge is attached to or removed from the holding member, wherein the holding member is configured to pivot around a holding-member axis from the first position via the second position to a third position where the holding member is raised from the second position, and wherein the moving path is inclined upward when the holding member is in the third position.

12. The image forming apparatus according to claim 1, wherein a center of gravity of the top cover in the open position is projected within the apparatus body when the image forming apparatus is viewed from above.

13. The image forming apparatus according to claim 1, wherein the top cover is configured to support a light source which exposes at least one of the photosensitive drums.

14. The image forming apparatus according to claim 1, wherein the interlocking mechanism further includes a first engaging portion disposed in the apparatus body and a second engaging portion disposed on the top cover, and the first engaging portion engages with the second engaging portion in response to the movement of the top cover from the closed position to the open position.

15. The image forming apparatus according to claim 1, wherein the top cover is coupled to the holding member via a first engaging portion disposed in the apparatus body and a second engaging portion disposed on the top cover.

16. The image forming apparatus according to claim 15, wherein the first engaging portion includes a first gear and the second engaging portion includes a second gear.

17. The image forming apparatus according to claim 1, wherein the holding member is configured to hold the photosensitive drums which are arranged horizontally in line.

18. The image forming apparatus according to claim 1, wherein the interlocking mechanism is configured to move the holding member from the second position to the first position in response to movement of the top cover from the open position to the closed position.

19. The image forming apparatus according to claim 1, wherein the apparatus body has a bottom surface on which the image forming apparatus is configured to rest in an operating position, wherein an angle which the top cover in the open position forms with the bottom surface is smaller than 90 degrees, and wherein an angle which the holding member in the second position forms with the bottom surface is smaller than 90 degrees.

20. The image forming apparatus according to claim 1, wherein the interlocking mechanism further includes a first gear disposed on the top cover, wherein the first gear engages with one of the plurality of gears arranged in the apparatus body.

21. The image forming apparatus according to claim 20, wherein top cover is configured to pivot around a top-cover axis between the closed position and the open position, wherein the top-cover axis is a pivot axis of the first gear, and wherein the interlocking mechanism includes a second gear which is one of the plurality of gears arranged in the apparatus body, and the first gear engages with the second gear in response to the movement of the top cover from the closed position to the open position.

22. The image forming apparatus according to claim 21, wherein the pivot axis of the first gear passes through the first gear.

23. The image forming apparatus according to claim 20, wherein the first gear is a sector gear.

24. The image forming apparatus according to claim 1, wherein:

the holding member is configured to pivot around a holding-member axis between the first position and the second position; and the top cover is configured to pivot around a top-cover axis between the closed position and the open position, wherein the top-cover axis is parallel to the holding-member axis.

25. An image forming apparatus comprising:

an apparatus body;

a cartridge holder configured to hold one or more cartridges, the cartridge holder being coupled to the apparatus body and configured to move between a first position where the cartridge holder is disposed in the apparatus body and a second position where the cartridge holder is raised from the first position;

a top cover coupled to the apparatus body and configured to be moved between a closed position and an open position; and a gear system including a plurality of gears arranged in the apparatus body, wherein movement of the top cover from the closed position to the open position causes rotation of at least one of the plurality of gears, such that the rotation of the at least one of the plurality of gears moves the cartridge holder from the first position to the second position.

26. The image forming apparatus according to claim 25, wherein the gear system includes a first engaging portion disposed in the apparatus body and a second engaging portion disposed in the top cover, and the first engaging portion engages with the second engaging portion in response to the movement of the top cover from the closed position to the open position.

* * * * *